US006783336B2

(12) United States Patent
Kempfer et al.

(10) Patent No.: US 6,783,336 B2
(45) Date of Patent: Aug. 31, 2004

(54) FUEL SENDER ASSEMBLY

(75) Inventors: Stephen Thomas Kempfer, Canton, MI (US); DeQuan Yu, Ann Arbor, MI (US); Norman Nelson Krieger, Milford, MI (US); David Joseph Setsuda, Farmington Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 11 days.

(21) Appl. No.: 10/184,587

(22) Filed: Jun. 28, 2002

(65) Prior Publication Data

US 2004/0001769 A1 Jan. 1, 2004

(51) Int. Cl.[7] ..... F04B 17/00; F04B 35/04

(52) U.S. Cl. ..... 417/423.1; 417/423.14; 310/71; 123/509

(58) Field of Search ..... 417/423.1, 423.3, 417/423.9, 423.14, 423.15; 310/71.87; 137/565.01; 123/509, 497; 439/190, 76.2

(56) References Cited

U.S. PATENT DOCUMENTS

| | | | | | |
|---|---|---|---|---|---|
| 4,651,701 | A | | 3/1987 | Weaver | 123/509 |
| 4,653,835 | A | | 3/1987 | Schulte et al. | 339/128 |
| 4,694,857 | A | | 9/1987 | Harris | 137/565 |
| 4,747,388 | A | | 5/1988 | Tuckey | 123/514 |
| 4,776,315 | A | | 10/1988 | Greiner | 123/509 |
| 4,869,225 | A | | 9/1989 | Nagata et al. | 123/509 |
| 4,909,745 | A | * | 3/1990 | Hayashi | 439/76 |
| 4,945,884 | A | | 8/1990 | Coha et al. | 123/509 |
| 4,961,018 | A | | 10/1990 | Akhter | 310/87 |
| 4,974,570 | A | | 12/1990 | Szwargulski et al. | 123/509 |
| 5,038,741 | A | | 8/1991 | Tuckey | 123/509 |
| 5,080,077 | A | | 1/1992 | Sawert et al. | 123/514 |
| 5,141,410 | A | * | 8/1992 | Fujii | 417/423.7 |
| 5,203,304 | A | * | 4/1993 | Hafner et al. | 123/456 |
| 5,398,659 | A | | 3/1995 | Zimmerman et al. | 123/514 |
| 5,399,075 | A | * | 3/1995 | Frank et al. | 417/423.1 |
| 5,454,697 | A | | 10/1995 | Nakanishi | 417/423.3 |
| 5,482,444 | A | | 1/1996 | Coha et al. | 417/363 |
| 5,520,547 | A | * | 5/1996 | Hamaoka et al. | 439/206 |
| 5,520,548 | A | * | 5/1996 | Hotea et al. | 439/358 |
| 5,593,287 | A | | 1/1997 | Sadakata et al. | 417/366 |
| 5,607,324 | A | | 3/1997 | Saur et al. | 439/544 |
| 5,649,514 | A | | 7/1997 | Okada et al. | 123/514 |
| 5,758,627 | A | | 6/1998 | Minagawa et al. | 123/509 |
| 5,762,049 | A | | 6/1998 | Jones et al. | 123/514 |
| 5,762,481 | A | * | 6/1998 | Oi | 417/423.3 |
| 5,797,376 | A | | 8/1998 | Frank et al. | 123/509 |
| 5,961,293 | A | * | 10/1999 | Clemmons et al. | 417/44.2 |
| 5,992,394 | A | | 11/1999 | Mukaidani et al. | 123/509 |
| 6,029,633 | A | | 2/2000 | Brandt | 123/509 |
| 6,142,126 | A | | 11/2000 | Kanamaru | 123/509 |
| 6,216,671 | B1 | * | 4/2001 | Sawert et al. | 123/509 |
| 6,422,839 | B1 | * | 7/2002 | Brockner et al. | 417/423.7 |

FOREIGN PATENT DOCUMENTS

| | | | | |
|---|---|---|---|---|
| EP | 0747592 A1 | | 12/1996 | F02M/37/10 |
| GB | 2292267 A | | 2/1996 | F02M/37/10 |
| GB | 2 292 267 A | * | 2/1996 | F02M/37/10 |

* cited by examiner

*Primary Examiner*—Justine R. Yu
*Assistant Examiner*—Han Lieh Liu
(74) *Attorney, Agent, or Firm*—Brinks Hofer Gilson & Lione

(57) ABSTRACT

A fuel sender assembly comprises an in-tank electrical connection to an electric fuel pump that is formed between a socket member and a plug element, in which the plug element includes a terminal that is received in a receptacle in the socket member. The socket element comprises a socket wall that extends about the socket face. The plug element also includes a plug wall that sealingly engages the socket wall to prevent the electrical contact from exposure to fuel vapors within the tank.

10 Claims, 5 Drawing Sheets

FUEL SENDER ASSEMBLY

BACKGROUND OF THE INVENTION

In an automotive vehicle, fuel is supplied to an internal combustion engine from a fuel tank by a fuel sender assembly. The fuel sender assembly includes an electric fuel pump. It is common practice to locate the fuel pump within the fuel tank. Electrical connections to the fuel pump are made through a mounting plate that seals an opening in the body of the fuel tank. Wires connect terminals on the fuel pump to terminals on the inner surface of the mounting plate, which in turn are connected by external wires to the electrical system of the vehicle.

Under normal conditions, the fuel-rich vapors within the tank are deficient in oxygen and do not sustain combustion. Nevertheless, it is desired to prevent electrical sparking from contact with fuel vapors within the tank, even under extraordinary conditions, for example, catastrophic breach of the tank. One cause of sparking may occur in the event that the fuel pump becomes dislodged and the terminals become disconnected while charged. Sparking may also occur if the wires within the tank become worn or damaged.

Therefore, it is desired to provide a fuel sender assembly that includes an in-tank fuel pump and wherein in-tank electrical connection to the fuel pump are sealed to prevent contact with fuel vapors and are isolated to prevent sparking therebetween. Also, in the event that the fuel pump becomes dislodged, it is desired that electrical terminals become disconnected while still sealed and prior to contact with fuel vapors.

TECHNICAL FIELD OF THE INVENTION

This invention relates to a fuel sender assembly that includes an electrical fuel pump located within a fuel tank. More particularly, this invention relates to such fuel sender assembly that includes an in-tank electrical connection to the fuel pump that is sealed from contact with fuel vapors and to prevent sparking in the event of disconnect.

BRIEF SUMMARY OF THE INVENTION

In accordance with this invention, a fuel sender assembly comprises an in-tank electrical connection to an electric fuel pump located within a fuel tank. The electrical connection is formed between a socket member and a plug element arranged about a common axis. The socket member comprises an insulative body that includes a socket face transverse to the axis and a socket wall that extends axially about the socket face. At least one receptacle extends axially from the socket face for receiving a terminal. An electrical contact is disposed within the insulative body in communication with the receptacle and is adapted for connection to an external power source. The plug element includes a plug face facing the socket face and at least one electrical terminal axially protruding from the plug face. The terminal is received in the receptacle in sliding contact with the electrical contact to form the electrical connection. The plug element further comprises a plug wall that surrounds the terminal spaced apart therefrom and sealingly engages the socket wall. The seal prevents the electrical connection between the electrical contact within the socket member and the terminal of the plug element from being exposed to fuel vapors within the fuel tank. Thus any sparking, for example, in the event the fuel pump becomes dislodged, is contained from communicating with the fuel vapors.

In one aspect of this invention, the socket member is mounted in a mounting plate in the fuel tank, and the plug element is affixed to the fuel pump, so that the electrical connection therebetween is accomplished without in-tank wiring that might become damaged or worn and lead to sparking. Optionally, wiring with the tank may be enclosed within a conduit to prevent exposure to fuel vapors.

BRIEF DESCRIPTION OF THE DRAWINGS

The present invention will be further illustrated with reference to the accompanying drawings wherein.

DETAILED DESCRIPTION OF A PREFERRED EMBODIMENT

Figure 1:
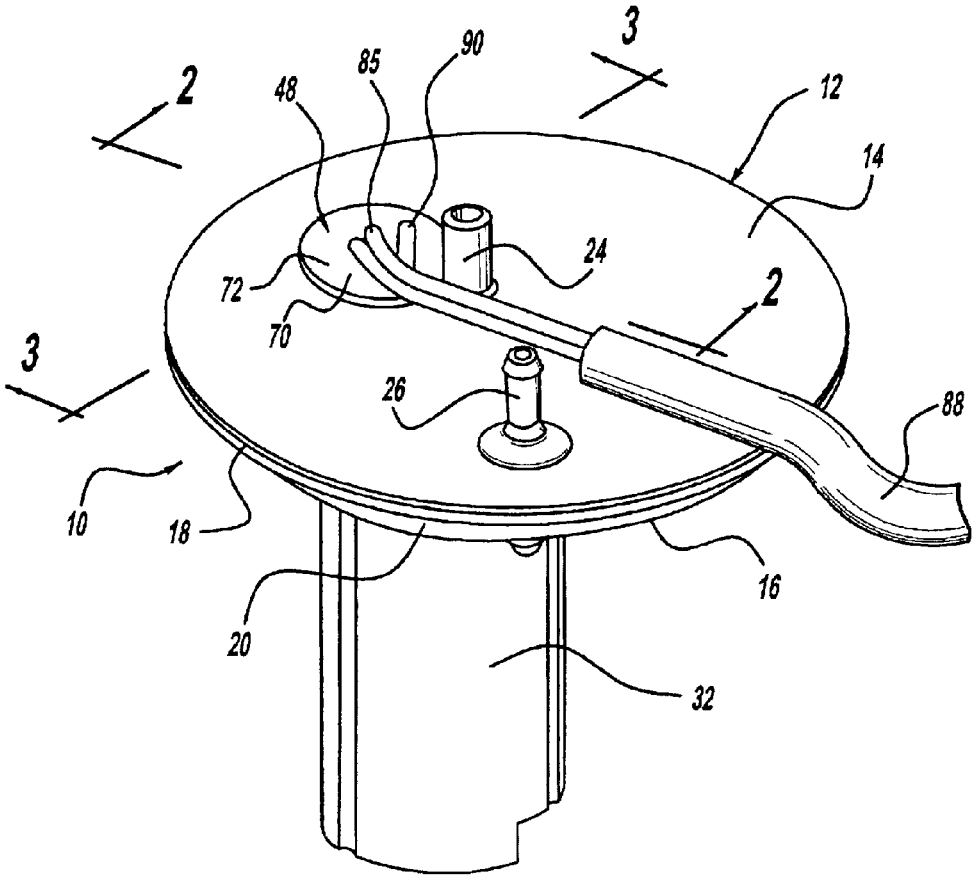
FIG. 1 is a perspective view of a fuel sender assembly in accordance with the preferred embodiment of this invention.
Figure 2:
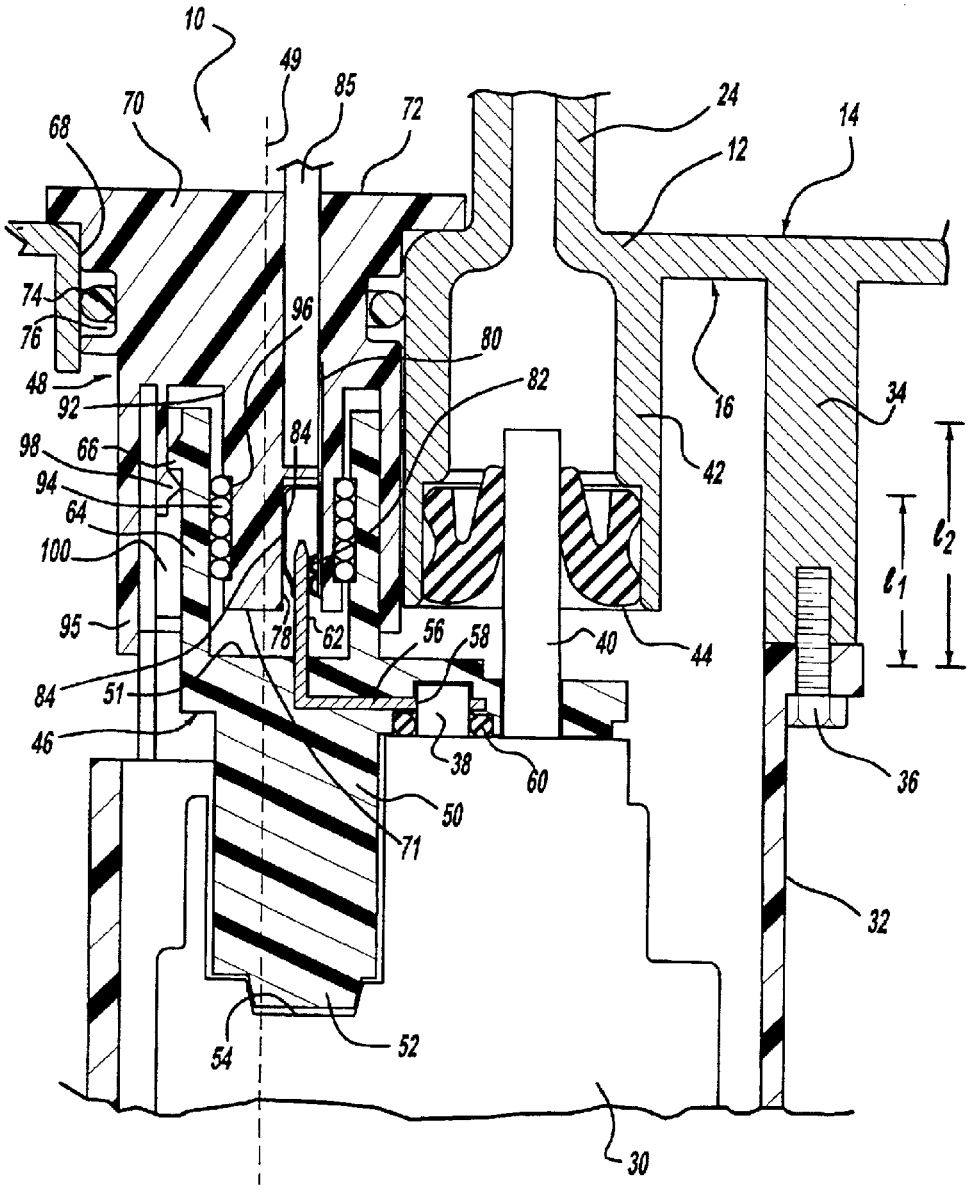
FIG. 2 is a cross-sectional view of a portion of the fuel sender assembly in FIG. 1, taken along lines 2—2 in the direction of the arrows.
Figure 3:
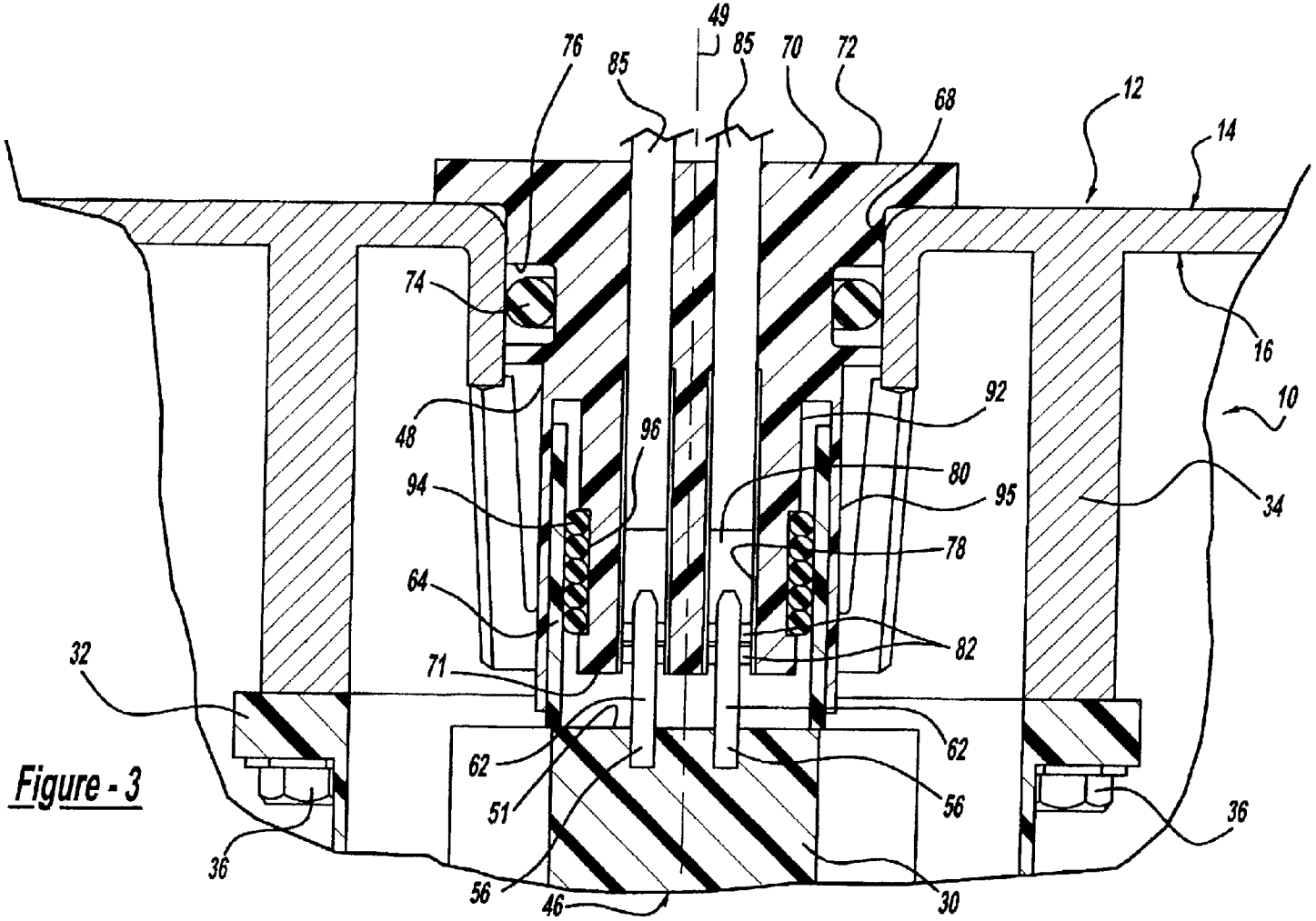
FIG. 3 is a cross-sections view of a portion of the fuel sender assembly in FIG. 1, taken along lines 3—3 in the direction of the arrows.

Referring to FIGS. 1–4, there is depicted a fuel sender assembly 10 in accordance with a preferred embodiment of this invention that is adapted to be mounted in a fuel tank (not shown) of an automotive vehicle for supplying fuel to an internal combustion engine. The fuel may be gasoline for a spark ignition engine or diesel fuel for a diesel engine. Assembly 10 includes a mounting plate 12 that is sized and shaped to be positioned within an opening in a wall of the fuel tank. In this arrangement, plate 12 includes an exterior 14 accessible from outside the fuel tank and an interior 16 within the fuel tank. Plate 12 hermetically seals the opening, and for this purpose includes the perimeter lip 18 that overlies the outer wall about the opening in the fuel tank and a sealing ring 20 that seals against the opening.

Plate 12 includes a supply port 24 adapted to be coupled to a fuel line for receiving fuel from the output of a fuel pump and delivering the fuel to the engine. A second port 26 is provided for return flow from the engine.

Fuel sender assembly 10 comprises an electric fuel pump 30. A preferred fuel pump is a regenerative vane pump. Alternately, a georotor or other suitable fluid pump may be employed. Fuel pump 30 is held by a retainer 32, which in turn is mounted to a boss 34 of plate 12 by bolts 36. Pump 30 includes an outlet tube 40 that extends through a sealing ring 44 received in an inner end section 42 of supply port 24. During operation, fuel is pumped through outlet tube 40 and supply port 24 enroute to the engine.

Pump 30 also includes posts 38 for making electrical connections for driving the pump. In accordance with this embodiment, electrical connections to fuel pump 30 are made by a plug element 46 mounted onto the fuel pump and a socket member 48 mounted in plate 12. Plug 46 and socket 48 are coaxially arranged along an axis 49. Axial movement of the plug relative to the socket connects or disconnects the plug to or from the socket.

Plug 46 comprises an insulative body 50 formed of molded plastic and including a plug face 51 transverse to axis 49 and facing socket 48. Body 50 includes a locator 52 received in a correspondingly shaped cavity 54 in the exterior of the fuel pump. Electrically conductive metallic strips 56 are embedded within body 50. At one end, each strip 56 defines a circular opening 58 that is pressed fitted about post 38 on fuel pump 30. A gasket 60 encircles post 38 between the fuel pump and strip 56. Each strip 56 also comprises a terminal 62 that protrudes axially from plug face 51 in the direction of socket 48 for making an electrical connection thereto. Terminal 62 are surrounded by a plug wall 64 that is integrally molded with body 50 and extends axially about plug face 51. Wall 64 includes a tab 66 disposed between axial guides 100, for locking plug 46 in socket 48.

Socket member 48 is formed of a molded insulative body 70 that includes socket face 71 transverse to axis 49 within the fuel tank in facing relationship to plug face 51. Socket 48 is received in an opening 68 in plate 12 and includes an external surface 72 accessible from outside the fuel tank. An O-ring gasket 74 received in a groove 76 in the peripheral surface of insulative body 70 hermetically seals insulative body 70 within plate 12. Body 70 defines receptacles 78 for receiving terminals 62 for making the desired electrical connection. Metal strips 80 are integrally molded into body 50 and extends into receptacle 78. Metal strip 80 includes contacts 82 that engage terminal 62 to make electrical connection therebetween. A spring 84 located within receptacle 78 urges terminal 62 against contacts 82. Metal strips 80 are bonded to wires 85 that are molded into body 70 and extend beyond external surface 72 for attaching to a wiring harness 88 that connects to the electrical system of the vehicle. Wire harness 88 also includes wires 90 that are embedded within body 70 apart from wires 86 and are connected to a fuel level sensor (not shown).

In accordance with this invention, electrical connections between terminal 62 of plug 46 and contacts 82 of socket 48 are isolated from vapors within the fuel tank. For this purpose, body 70 includes a socket wall 92 that extends axially about socket face 71 and is sized and shaped to fit snuggly against plug wall 62. A gasket 94 is disposed in a groove 96 in wall 92 and engages the wall 64 to form a hermetic seal. Body 70 also includes a wall peripheral 95 that extends axially spaced apart from wall 92 with wall plug 64 interposed therebetween. Wall 95 presses plug wall 64 against wall 92 and maintains the seal therebetween. A tab 98 is disposed between wall 92 and 95 for locking with tab 66 on wall 64 of plug 46 to secure terminals 62 within receptacles 84. Guides 100 about tab 98 press wall 64 against wall 92 while providing clearance for tab 98.

Figure 4:
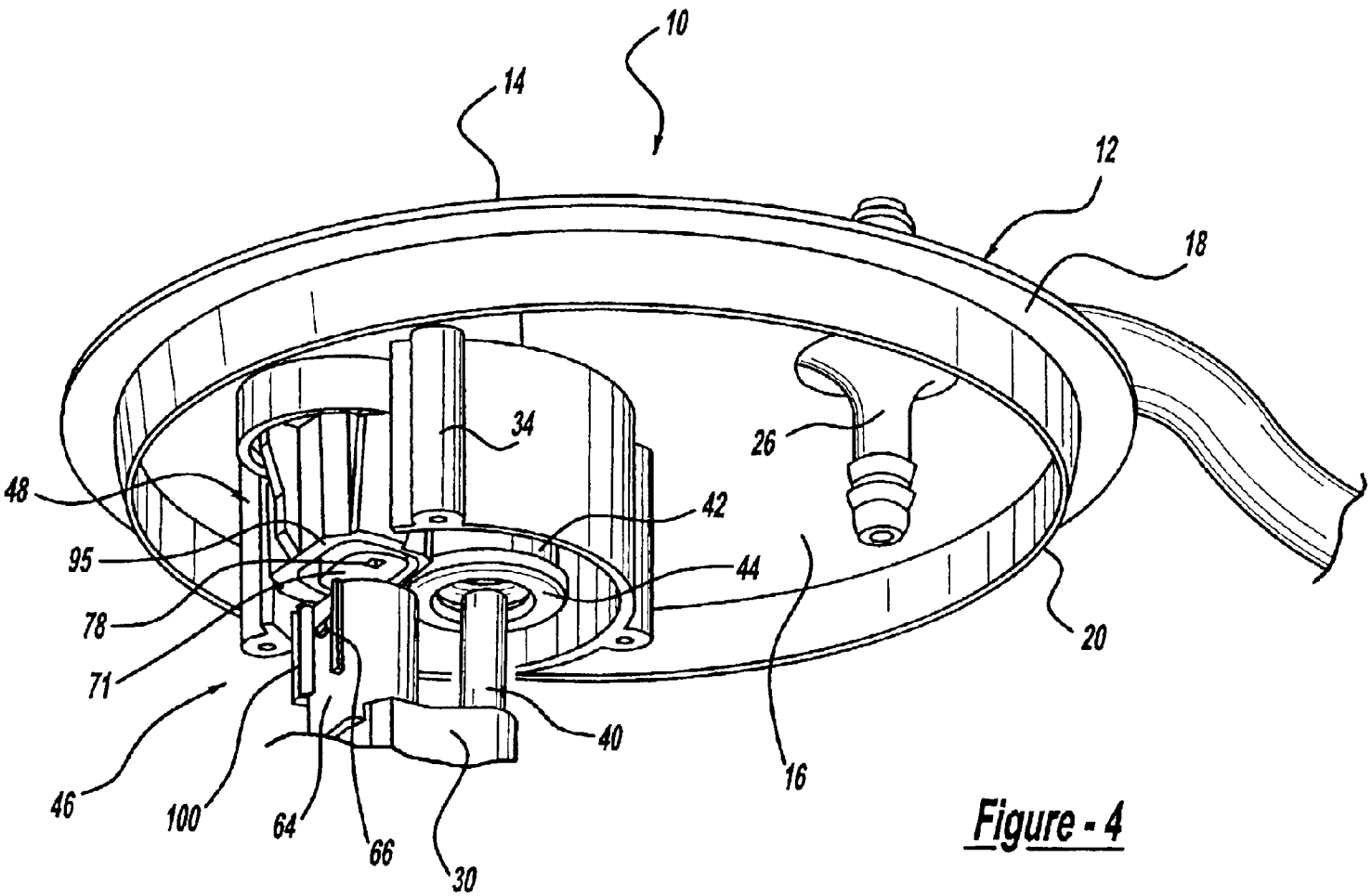
FIG. 4 is an exploded view of a portion of the fuel sender assembly in FIG. 1, showing in-tank connections.

Referring to FIG. 4, there is depicted an arrangement of fuel pump 30 and mounting plate 12 in preparation for assembly to form electrical connections to power the fuel pump. Prior to assembly, socket 48 is mounted within opening 68 of plate 12, with the O-ring gasket 74 forming a hermetic seal therebetween. Plug 46 is affixed to fuel pump 30 with strips 46 press fit onto posts 38. To complete assembly, outlet tube 40 is inserted through sealing ring 44 into end section 42 of supply port 24. As fuel pump 30 advances towards plate 12, terminals 62 are inserted within receptacles 78 and into contact with contacts 82, secured there against by springs 84, thereby forming electrical connection between socket 48 and plug 46. Wall 64 of plug 46 concurrently is inserted between wall 92 and wall 95, engaging gasket 94 to form a hermetic seal with wall 92. When fully installed tab 66 engages tab 98 to lock plug 46 in position. Thereafter, retainer 32 is secured to boss 34 by bolts 36 to complete the assembly.

During operation, wiring harness 88 is connected to the vehicle electrical system to provide electrical power to wires 85. Strips 80 are electrically connected to wires 85 and through contacts 82 to terminals 62 of plug 46. In this manner, electrical power is supplied through strips 56 to post 38 on fuel pump 30.

During normal operation, electrical connections between terminals 62 and contacts 82 supply electrical power to fuel pump 30. A major advantage of this invention is that sparking between terminals 62 and contacts 82 is contained within a sealed space in the event that fuel pump 30 becomes dislodged from plate 12. When plug 46 is assembled with socket 48, gasket 94 hermetically seals the plug to the socket to prevent fuel vapors within the tank from communicating with terminals 62. When fuel pump 30 is dislodged, terminals 62 are retracted from receptacles 78. While not limited to any particular theory, in the preferred embodiment, terminals 62 extend axially from plug face 51 by a first length l, and plug wall 64 extends axially from the plug face by a second length, $l_2$ that is greater than the first length. As a result, walls 64 remain in contact with gasket 98 even though plug 46 is axially displaced from plug 48 by a distance sufficient to break electrical contact between terminals 62 and contacts 82. Thus, seal 94 maintains contact with wall 64 until terminals 62 are withdrawn from contacts 82. In the event that residual electrical charge on terminals 62 is sufficient to cause sparking, sparking is isolated from fuel vapors by the continued seal formed by seal 94.

Figure 5:
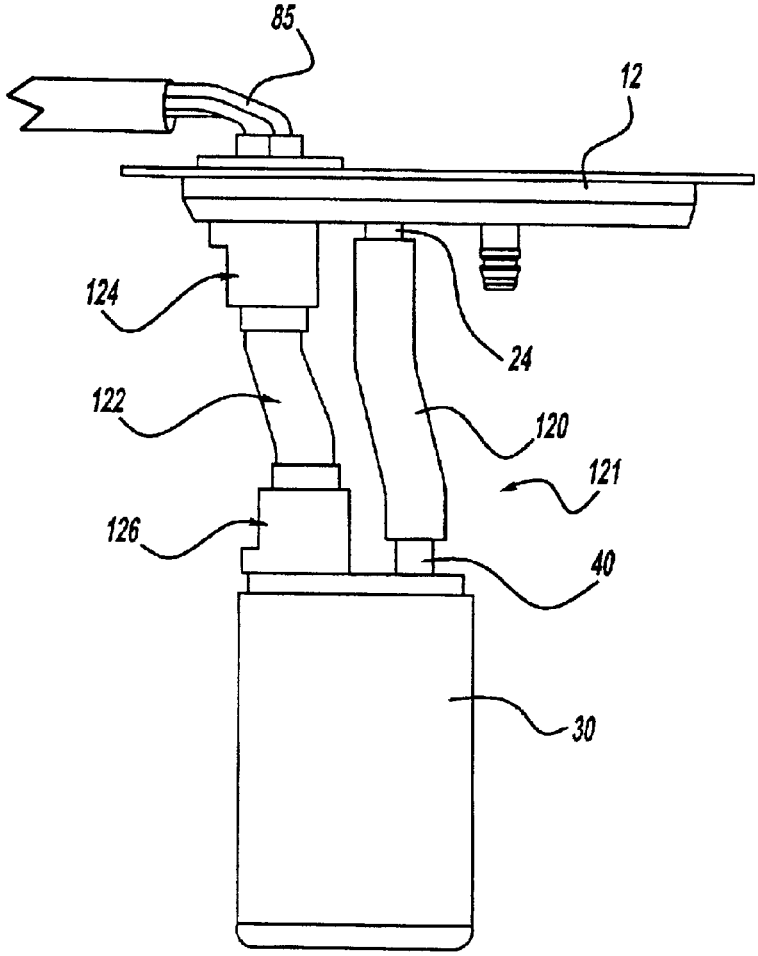
FIG. 5 is an elevational view of a fuel sender assembly in accordance with an alternate embodiment of this invention.

In the embodiment shown in FIGS. 1–4, fuel pump 30 is mounted directly into mounting plate 12, without wiring therebetween. It is common practice to locate mounting plate 12 in an upper wall of the fuel tank. It is often desired to locate the fuel pump in a lower region of the fuel tank to assure continued supply of fuel to the fuel pump when the fuel tank is partially filled. FIG. 5 shows an embodiment of this invention wherein a fuel sender assembly 121 comprises a fuel pump 30 that is remote from mounting plate 12 to permit location in a bottom region of the fuel tank. In the embodiment shown in FIG. 5, elements similar to those in FIGS. 1–4 are indicated by like numerals. A flexible conduit 120 connects outlet tube 40 of fuel pump 30 to supply port 24 of mounting plate 12. Electrical connections are made between mounting plate 12 and fuel pump 30 through wires sealed within conduit 122. In this embodiment, fuel sender assembly 121 comprises a first electrical connection 124 at mounting plate 12. Connection 124 comprises a socket member similar to socket member 48 in FIGS. 1–4, the details whereof are not shown. The socket member is mounted in mounting plate 12, and connected through wires 85 to the vehicle electrical system. A plug member is connected to the socket assembly, is similar to plug member 46 in FIGS. 1–4, but with terminals connected to wires instead of to posts on the fuel pump. Also, as shown in FIG. 5, the fuel sender assembly includes a second electrical connection 126 at fuel pump 30. Electrical connection 126 comprises a plug member mounted on the fuel pump and similar to plug member 46 in FIGS. 1–4. In addition, electrical connection 126 includes a socket member connected to the plug member, which socket member is similar to socket member 48 in FIGS. 1–4 except that the socket member is connected to wires within conduit 122.

In the embodiment shown in FIG. 5, the fuel sender assembly includes vapor-sealed electrical connections at both the fuel pump and the mounting plate. Alternatively, the electrical power may be suitably supplied to the fuel pump using only a single in-tank terminal connection. Thus, wires 85 may extend through the mounting plate to the fuel pump, and there connect to terminals on the fuel pump through electrical connection 126, so that electrical connection 126 form the sole in-tank connection to the terminals. A seal is provided between the wires and the mounting plate to prevent fuel vapor leakage. The seal may be suitably formed by embedding the wires within a molded plug that is installed in the mounting plate. In still another arrangement, wires may be permanently affixed to pump 30 and connected to terminals on the mounting plate through an electrical connector 124, which then forms the sole in-tank connection to terminals.

While this invention has been described in terms of certain embodiments thereof, it is not intended to be limited to the described embodiments, but only to the extent set forth in the claims that follow.

We claim:

1. A fuel sender assembly for use in a fuel tank, said fuel sender assembly comprising an electric fuel pump disposed within the fuel tank, and an in-tank electrical connection to the electric fuel pump, said in-tank electrical connection comprising a socket member having an axis and comprising an insulative body, said insulative body comprising a socket face transverse to the axis and a socket wall extending axially about the socket face, said socket member defining at least one receptacle opening at said socket face and extending axially therefrom, said socket member further comprising at least one electrical contact within said insulative body in communication with said receptacle and adapted for connection to an external power source, and a plug element coaxially arranged with the socket member and including a plug face facing the socket face, at least one electrical terminal axially protruding from the plug face by a first distance and received within the receptacle in sliding contact with said electrical contact, and a plug wall surrounding said electrical terminal spaced apart therefrom and sealingly engaging the socket wall, said plug wall extending from the plug face by a second distance greater than the first distance, and sufficient to maintain said sealing engagement between said plug wall and said socket wall despite axial displacement of the plug face from the socket face by a distance sufficient to break contact between said terminals and said contacts.

2. A fuel sender assembly in accordance with claim 1 wherein said socket member further comprises a peripheral wall axially extending about the socket wall spaced apart therefrom, and wherein the plug wall is interposed between the socket wall and the peripheral wall, whereby the peripheral wall urges the plug wall against the socket wall to maintain sealing engagement therebetween.

3. A fuel sender assembly in accordance with claim 1 further comprising a mounting plate mounted in the fuel tank and comprising said socket member.

4. A fuel sender assembly in accordance with claim 1 wherein said plug member is mounted on the electric fuel pump.

5. A fuel sender assembly in accordance with claim 1 further comprising a gasket interposed between the socket wall and the plug wall for forming a seal therebetween.

6. A fuel sender assembly for use in a fuel tank, said fuel sender assembly comprising a mounting plate mounted in the fuel tank, an electric fuel pump disposed within the fuel tank, and an electrical connection for connecting the electric fuel pump to an external power source, said electrical connection comprising a socket member mounted in the mounting plate and comprising an insulative body having an axis, said insulative body comprising a socket face within the fuel tank, a socket wall extending axially about the socket face and receptacles opening at the socket face and extending axially therefrom, said socket further comprising electrical contacts within said insulative body in communication with said receptacles spaced apart from said socket face and adapted for connection to an external power source, and a plug element coaxially mounted on the fuel pump and including a plug face facing the socket face, electrical terminals axially protruding from the plug face received within the receptacles in sliding contact with said contacts, and a plug wall axially extending from the plug face spaced apart from the terminals and sealingly engaging the socket wall, the plug wall having a height sufficient to maintain said sealing engagement between said plug wall and said socket wall despite axial displacement of the plug face from the socket face by a distance sufficient to break contact between said terminals and said contacts.

7. A fuel sender assembly in accordance with claim 6 wherein said socket member further comprises a peripheral wall axially extending about the socket wall spaced apart therefrom, and wherein the plug wall is interposed between the socket wall and the peripheral wall, whereby the peripheral wall urges the plug wall against the socket wall to maintain sealing engagement therebetween.

8. A fuel sender assembly in accordance with claim 6 wherein the terminals axially extend a first axial distance from the plug face and wherein the plug wall axially extends an from said plug face a second distance greater than the first distance.

9. A fuel sender assembly for use in a fuel tank, said fuel sender assembly comprising a mounting plate mounted in the fuel tank, an electric fuel pump disposed within the fuel tank, and an electrical connection for connecting the electric fuel pump to an external power source, said electrical connection comprising a socket member mounted in the mounting plate and having an axis, said socket comprising an insulative body having a socket face within the fuel tank perpendicular to the axis, socket wall axially about the socket face and at least two receptacles axially extending from the socket face, said socket further comprising at least two electrical contacts embedded within said insulative body, each said contact communicating with a said receptacle spaced apart from said socket face by a predetermined distance and coupled to a lead outside said fuel tank for connection to the external power source, and a plug mounted on the fuel pump and including a plug face confronting the socket face and at least two electrical terminals having a terminal height from the plug face, each said terminal being axially received within one said receptacle in sliding contact with said contact therein, said plug further comprising a wall element surrounding said terminals and sealingly engaging the socket wall, said wall having a wall height from said plug face greater than said terminal height and sufficient to maintain said sealing engagement with said socket wall despite axial displacement of the plug face from the socket face by a distance sufficient to break contact between said terminals and said contacts.

10. A fuel sender assembly in accordance with claim 9 wherein the socket member further comprises a peripheral wall extending axially and spaced apart from the socket wall, and wherein the wall element is interposed between the socket wall and the peripheral wall.

* * * * *